US007083079B2

(12) United States Patent
Bethke

(10) Patent No.: US 7,083,079 B2
(45) Date of Patent: Aug. 1, 2006

(54) DOUBLE POSTCARD PRESSURE SEAL FORM CONSTRUCTION

(75) Inventor: Darvin Richard Bethke, Forest Lake, MN (US)

(73) Assignee: Moore Wallace North America, Inc., Stamford, CT (US)

( * ) Notice: Subject to any disclaimer, the term of this patent is extended or adjusted under 35 U.S.C. 154(b) by 368 days.

(21) Appl. No.: 10/614,898

(22) Filed: Jul. 9, 2003

(65) Prior Publication Data

US 2005/0006448 A1 Jan. 13, 2005

(51) Int. Cl.
*B42D 15/00* (2006.01)

(52) U.S. Cl. ..... 229/92.8; 229/92.1; 229/300

(58) Field of Classification Search ..... 229/92.8, 229/300, 305, 92.1, 92.3
See application file for complete search history.

(56) References Cited

U.S. PATENT DOCUMENTS 2,983,431 A 5/1961 Turan
5,370,304 A * 12/1994 Sauerwine et al. ..... 229/304
5,482,753 A 1/1996 Langan et al.
5,595,404 A 1/1997 Skees
5,598,970 A * 2/1997 Mudry et al. ..... 229/305
5,667,134 A 9/1997 Olson et al.
5,752,647 A 5/1998 Schubert et al.
5,862,978 A 1/1999 Forrest
5,901,903 A 5/1999 Sanders et al.
5,950,910 A 9/1999 Petkovsek
6,039,242 A 3/2000 Tee
6,047,880 A 4/2000 Petkovsek
6,126,064 A * 10/2000 Hutchinson ..... 229/92.1
6,179,202 B1 1/2001 Alexander et al.

OTHER PUBLICATIONS

U.S. Application of Hutchinson for Certified Mailer With Return Receipt Postcard filed Jul. 2, 2003.

* cited by examiner

*Primary Examiner*—Jes F. Pascua
(74) *Attorney, Agent, or Firm*—Hanley, Flight & Zimmerman, LLC

(57) ABSTRACT

A USPS postcard mailer with return postcard is formed from a single sheet of, e.g., 28# paper utilizing pressure seal cohesive material. This is accomplished by applying cohesive material in a unique pattern and then folding the 28# pattern into a double V-fold construction to create the return receipt postcard required by and meeting the requirements of USPS.

6 Claims, 5 Drawing Sheets

DOUBLE POSTCARD PRESSURE SEAL FORM CONSTRUCTION

BACKGROUND AND SUMMARY OF THE INVENTION

It is common for company and Government offices alike to mail notices to customers and area residents that may require a reply by the recipient. Where the reply includes confidential or semi-confidential information it is appropriate for the reply to be enclosed in an envelope. Where confidential or semi-confidential information is not included in the reply, such as where the reply is a questionnaire or notice of address change, the reply may be in the form of a postcard. This reduces postage charges for the reply. Indeed, postal rates for first class mailings differ substantially between letters and postcards. For non-automation mailings the difference in rates is currently $0.14. This provides a significant incentive to utilize postcards for a wide variety of specialized mailings.

It would be desirable for the outgoing mailer, including the notice or statement and the reply postcard, to itself qualify as a postcard to realize postal mail savings for a postcard versus first class mail.

A duplex printed postcard using 007 inch cardstock has been developed for this purpose and is disclosed in commonly owned U.S. Pat. No. 5,667,134, the entire disclosure of which is incorporated herein by this reference. While the '134 patent discloses a double postcard structure that comprises a notable advantage and improvement in the art, it would be desirable to provide a double postcard structure for which a postcard production can be accomplished with simplex (1 side) printing.

The present invention provides a double postcard (2-way postcard) pressure seal form construction that may be provided either as a single cut sheet 6×14 inch or continuous 2-up 12×14 inch of, e.g., 28# papaer. Unlike the 7 point two way paper postcard of the '134 patent, in the form construction of the invention variable and non-variable information are simplex printed on the front side of the form concurrently or in series. The backside of the form contains pressure seal cohesive chemistry to bond together and define a double postcard structure when folded in half. Suitable cohesive spots are also applied to the front of the form to permit closure of the double postcards to define a postcard mailer.

The present invention thus provides a USPS postcard mailer with return postcard from a single sheet of, e.g., 28# paper utilizing pressure seal cohesive material. This is accomplished by applying cohesive material in a unique pattern and then folding the 28# pattern into a double V-fold construction to create the return receipt postcard required by and meeting the requirements of USPS.

Thus, the invention may be embodied in an intermediate for a postcard mailer, comprising: a quadrate sheet of paper having parallel top and bottom edges, parallel first and second side edges perpendicular to the top edge and first and second faces; at least first, second and third fold lines parallel to said top and bottom edges dividing said sheet into at least first, second, third, and fourth panels, said first and fourth panels being substantially the same size and said second and third panels being substantially the same size; first adhesive areas provided on the second face of at least one of said first and fourth panels, and on the second face of at least one of and second and third panels for substantially permanently adhering mutually facing portions of said first and fourth panels and mutually facing portions of said second and third panels together as respective first and second postcard plies when said sheet is double V-folded about said fold lines.

The invention may also be embodied in a double postcard size mailer including an integral laminated postcard size reply mail piece which is detachable from said mailer, said mailer comprising: a quadrate sheet of paper having parallel top and bottom edges, parallel first and second side edges perpendicular to the top edge and first and second faces; at least first, second and third fold lines parallel to said top and bottom edges dividing said sheet into at least first, second, third, and fourth panels, said first and fourth panels being substantially the same size and said second and third panels being substantially the same size; first adhesive areas provided on the second face of at least one of said first and fourth panels, and on the second face of at least one of and second and third panels for substantially permanently adhering mutually facing portions of said first and fourth panels and mutually facing portions of said second and third panels together as respective first and second postcard plies when said sheet is double V-folded about said fold lines; and a second adhesive for securing said first and second postcard plies together as an outgoing mailer; said sheet being folded such that (1) said second surfaces of said first and fourth panels lie in contact and are adhered together by said first adhesive pattern to form said postcard size reply mail piece, and (2) said second surfaces of said second and third panels lie in contact and are adhered together by said first adhesive pattern to defining a postcard size outgoing mail piece, and (3) said first surfaces of said first and second panels lie in contact and are held together by said second adhesive.

BRIEF DESCRIPTION OF THE DRAWINGS

These and other objects and advantages of this invention will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
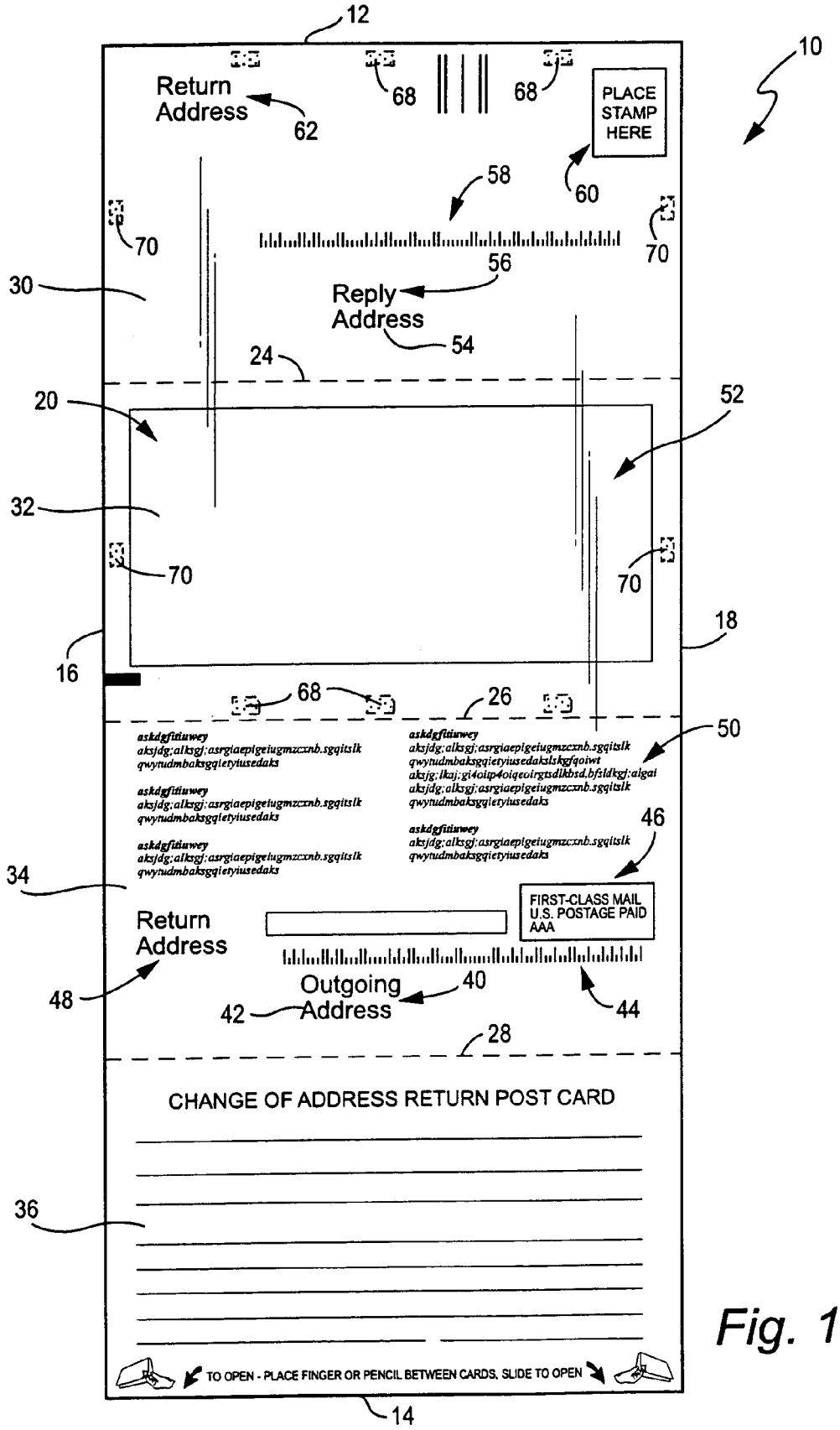
FIG. 1 is a plan view of a first face of an exemplary intermediate according to the present invention.
Figure 2:
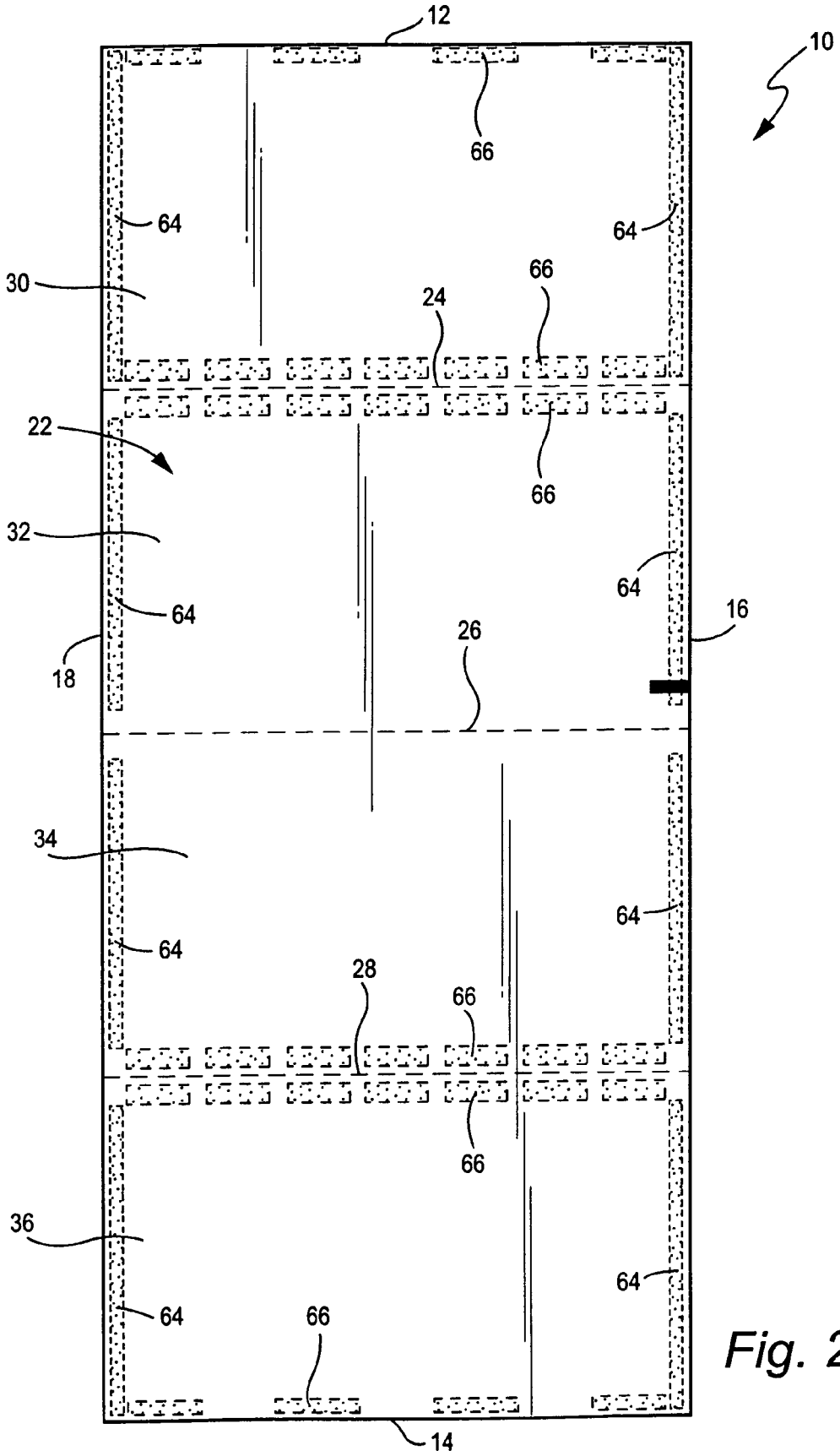
FIG. 2 is a plan view of the second face of the intermediate of FIG. 1.

An exemplary intermediate for a mailer-type business form having a return postcard is shown generally by reference number 10 in FIGS. 1 and 2. It includes a quadrate sheet of substantially opaque paper having parallel top and bottom edges 12,14 and parallel first and second side edges 16,18, respectively. The side edges are perpendicular to the top edge. The sheet further defines first and second faces 20,22, FIGS. 1 and 2, respectively. First, second and third fold lines 24,26,28 are provided parallel to the top and bottom edges for dividing the sheet into four panels 30,32, 34,36. The first and fourth panels are substantially equal size and the second and third panels are substantially equal size. According to an exemplary embodiment, as illustrated, all four panels are the same size.

With reference to the presently preferred, illustrated embodiment, the first panel 30 is disposed as the top panel of the form, the second panel 32 is disposed as the second panel of the form, the third panel 34 is disposed as the third panel of the form so that the second panel is between the first and third panels, and the fourth panel 36 is disposed as the bottom panel of the form so that the third panel is between the second and fourth panels.

In the presently proposed embodiment, where a return postcard formed by the first and fourth panels is adapted to be removed and mailed by the end user, fold lines 24 and 28 comprise lines of weakness that facilitate separation of the return postcard formed by the first and fourth panels (as described in greater detail below) from the second and third panels. Fold lines 24 and 28 thus comprise lines of weakness such as perforation lines or die cut lines. Second fold line 26 may also comprise a line of weakness such as a perforated line or die cut line, or may merely be scored or creased to facilitate folding of the mailer since as presently proposed the second and the third panels are permanently attached. As will be apparent below, the invention is not limited to the described series and orientations of panels, except as required by the appended claims.

The intermediate 10 includes an outgoing address area 40 on the first face of the third panel 34. The outgoing address area is of a size and adapted to receive, e.g., a laser printed address or pre-printed address label. The outgoing address area can include indicia corners or other indicator such as a change in texture, tone or color of the paper to facilitate the determination of the proper location of the outgoing address. Such indicators, however, are not critical to the implementation of the invention. Human readable address indicia such as shown only schematically by indicia 42 in FIG. 1 is ultimately provided on the intermediate, for example, as it is passed through a printer. Other human or machine readable indicia may also be printed or pre-printed on the first face of the third panel, such as postal address bar coding 44, indicia for postal stamp application 46 and/or indicia for the sender's return address 48. If deemed necessary or desirable, the postage, return address and outgoing address indicia may be confined for example to the lower half of the third panel and the upper half portion of the third panel may include legalese and/or instructions 50 for the recipient, particularly where the mailer is a tax related or other document for which the information provided at 52 on the second panel 32 must be of prescribed format and/or otherwise fully occupies the second panel.

In the illustrated embodiment, the first face of the fourth panel 36 is pre-printed according to the type of return postcard provided. The first face of the first panel is also pre-printed or variably printed to include a reply address indicia 54 in a reply address area 56. Again, the reply address area 56 can include indicia corners or other indicator as described above with reference to the outgoing address area 40 to facilitate the determination of the proper location of the reply address where as such indicia is variably printed. Other human or machine readable indicia may also be printed or pre-printed on the first face of the first panel, such as postal address bar coding 58, indicia for postal stamp application and/or prepaid postal indicia 60, and a return address or lines for inserting return address at 62.

In the illustrated embodiment, the indicia preprinted and variably printed on the first face of the first and/or fourth panels is oriented in the same manner as the outgoing address indicia 42 provided on the first face of the second panel. This facilitates the variable printing process. It is to be understood, however, that the indicia, particularly on the first face of the first and fourth panels, can be inverted from the orientation shown, if deemed necessary or desirable for effective implementation of the invention. In this regard, as will be understood from a consideration of FIGS. 1, 3 and 4, when the intermediate is folded to form a mailer, the indicia provided on the first panel first face will be inverted relative to the indicia provided on the fourth panel first face. If it is preferred to have the indicia on each face of the return postcard commonly oriented, either the indicia on the first face of the first panel or the indicia on the first face of the fourth panel must be inverted so that when the intermediate is folded, the indicia is commonly directed on each face of the postcard.

As noted above, area 52 on the first face of the second panel is provided as pre-printed and/or variable data space and may carry semi-confidential or confidential information as described below, simplex printed thereon.

In the illustrated embodiment, the first and fourth panels are adapted to together define a return postcard. To this end, at least a portion of the first panel is adhered to at least a portion of the fourth panel so that the mutually attached portions of the first and fourth panels each comprise one ply or layer of the postcard.

Figure 3:
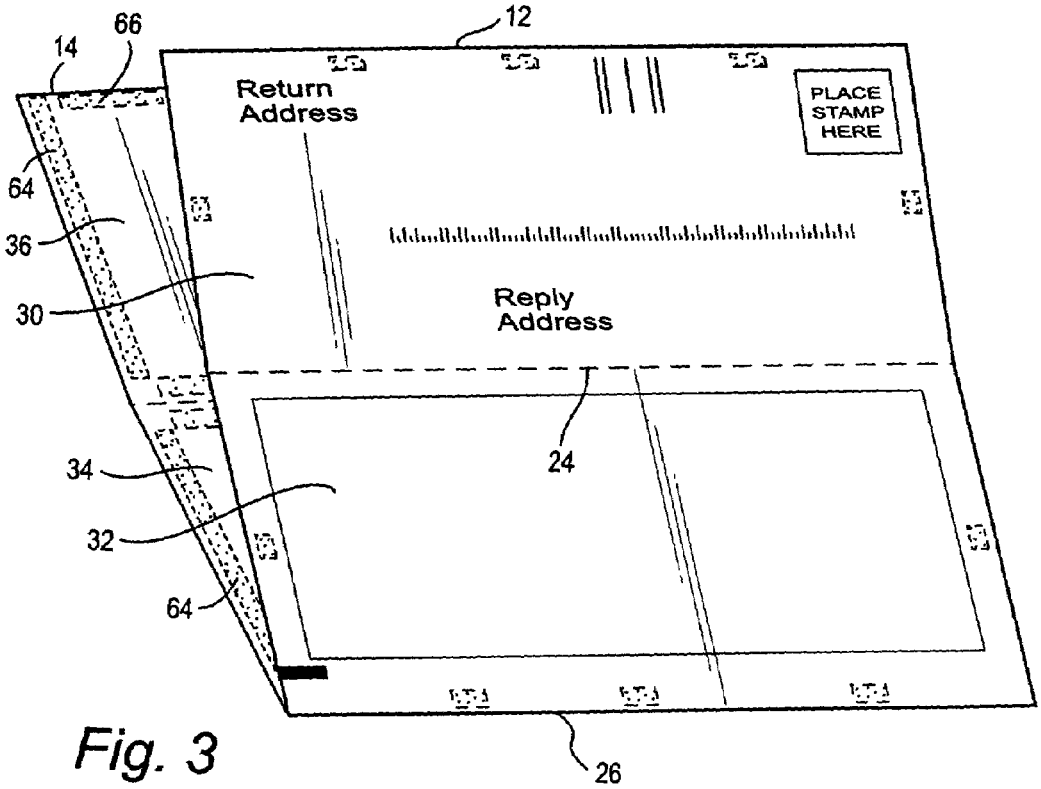
FIG. 3 is a perspective view showing the intermediate of FIGS. 1 and 2 being folded to define a two postcard mailer.

Thus, the intermediate further comprises a first plurality of adhesive patterns provided along at least some of the edges of the panels for holding the first through fourth panels together as a double postcard structure when the sheet is folded about fold line 26, as illustrated in FIG. 3. In the illustrated embodiment, the first adhesive patterns include elongated strips 64 provided on the second face of the first and/or fourth panels and on the second face of the second and/or third panels. As illustrated, the first adhesive patterns may also include adhesive strip(s) 66 on the second face of the first panel and/or the second face of the fourth panel adjacent the top and/or bottom edges of the respective panels, and on the second face of the second panel and or the second face of the third panel adjacent fold lines 24 and/or 28, respectively. It is to be understood that as an alternative to or in addition to strips 64, 66 about the perimeter of the sheet, adhesive may be provided within said perimeter.

Figure 4:
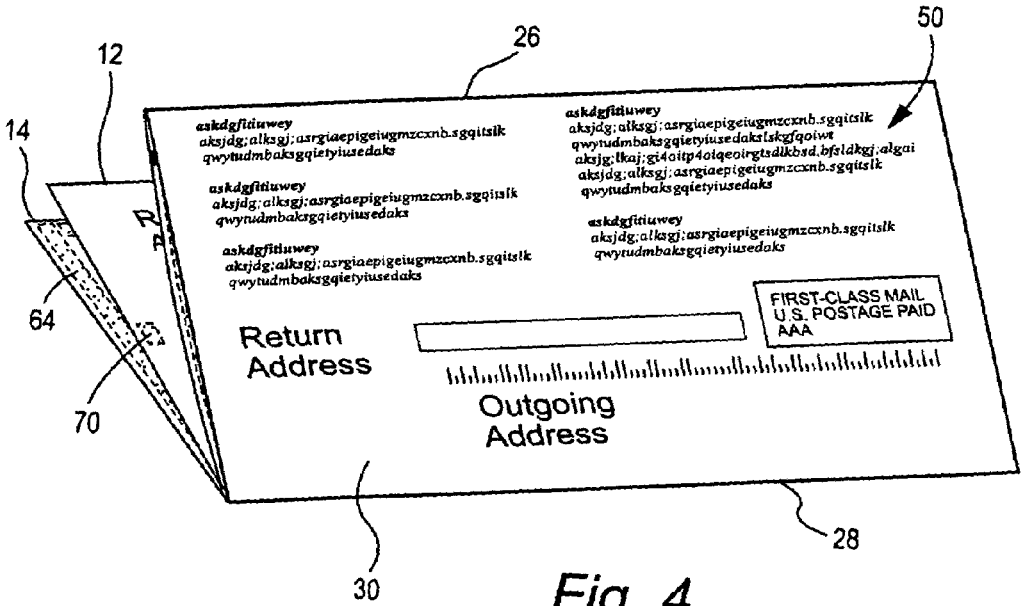
FIG. 4 is a perspective view showing the two postcard of FIG. 3 being folded in to an outgoing mailer.
Figure 5:
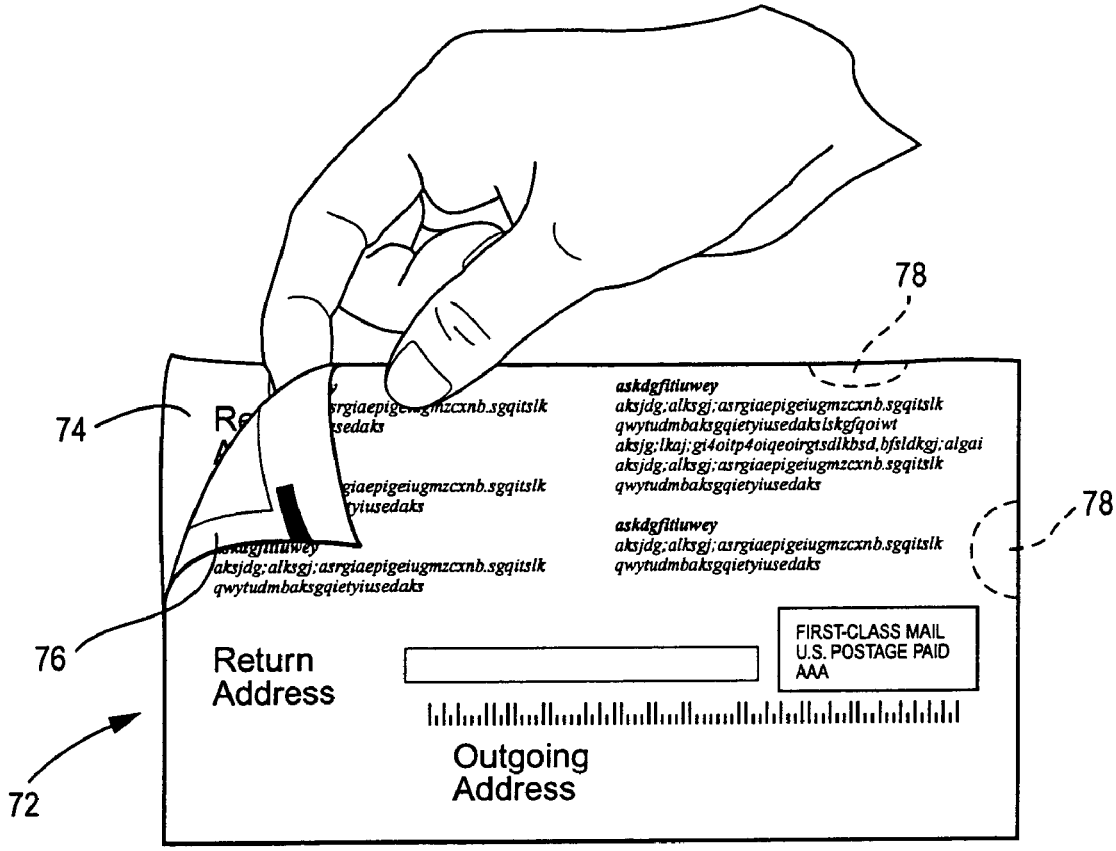
FIG. 5 is a perspective view showing the opening of the mailer of FIG. 4 by the end user.

The adhesive patterns preferably also include a second plurality of adhesive patterns for forming the outgoing mailer from the double postcards when the intermediate is folded about fold line 26, as shown in FIG. 4. In the illustrated embodiment, the second plurality of adhesive patterns comprise adhesive spots or strips 68 provided on the first panel first face adjacent the top edge 12 and/or on the second panel first face adjacent line of weakness 26 to hold the first and second panels in opposed facing relation in the folded configuration. The second plurality of adhesive patterns may also include adhesive spots or strips 70 provided on the first panel first face and/or on the second panel first face adjacent the side edges 16, 18. As an alternative, the second adhesive for holding the mailer may be provided by tabs 78 applied to the folded mailer, as described herein below.

Preferably the adhesive 64, 66 holding the intermediate in the double postcard configuration is of substantially permanent adhesive that is defined by pressure seal adhesive or cohesive for forming the double postcard structure upon folding and the application of suitable pressure to the adhesive region. In the alternative, however, the adhesive may be re-wettable adhesive, or a pressure sensitive adhesive covered by a release strip. Also, rather than continuous elements, the adhesive may be provided as discontinuous elements and/or in a pattern, shape or density other than that shown. However, Furthermore, the first adhesive areas 64, 66 for defining the double postcard are preferably substantially continuous to preclude delamination of the return postcard.

The adhesive areas 68,70 may take any configuration including dash lines, discontinuous dot configurations and the like. While the amount and spacing of such adhesive material should be at least sufficient to allow the mailer to be processed by U.S. Postal Service automated systems, it is preferred that the adhesive 68,70 be minimized to facilitate opening of the mailer, as described herein below, and to minimize the surface damage to, and residual glue on, the return postcard.

Although not shown, detachable tractor drive strips may be provided for the intermediate during processing. These strips are conventional for facilitating handling of the intermediate for printing or the like during manufacture of the mailer. The strips are typically provided where the intermediate is in continuous form. In the present case, where the outgoing mailer is sized and configured as a postcard, e.g. 6 inch width, the intermediate is a two up form for continuous feed, so that the side edges 16, 18 are lines of weakness between longitudinally adjacent intermediates. During normal processing, such strips (not shown) are slit off at an appropriate stage to define the top and bottom edges 12, 14. In constructing the mailer, after the intermediate is detached from the adjacent intermediate(s) continuously printed therewith (if any), and after slitting of any tractor drive strips (if provided), the intermediate is double V-folded as illustrated in FIGS. 3–4, typically by conventional folding equipment, and then run through a suitable sealing machine (typically conventional equipment, either heat sealing or pressure sealing) for activating the first and second adhesive patterns. Typically, the intermediate shown in FIGS. 1 and 2 has a length between top and bottom edges of about 14 inches to produce a standard size postcard following double V-folding.

When the outgoing addressee receives the mailer 72, the mailer is then comprised of first and second plys 74, 76 with the first ply 74 being defined by the adhered first and fourth panels 30, 36 that comprise the return postcard, with the second ply 76 being defined by the adhered second and third panels 32, 34 that comprise the Notice for the recipient.

Figure 6:
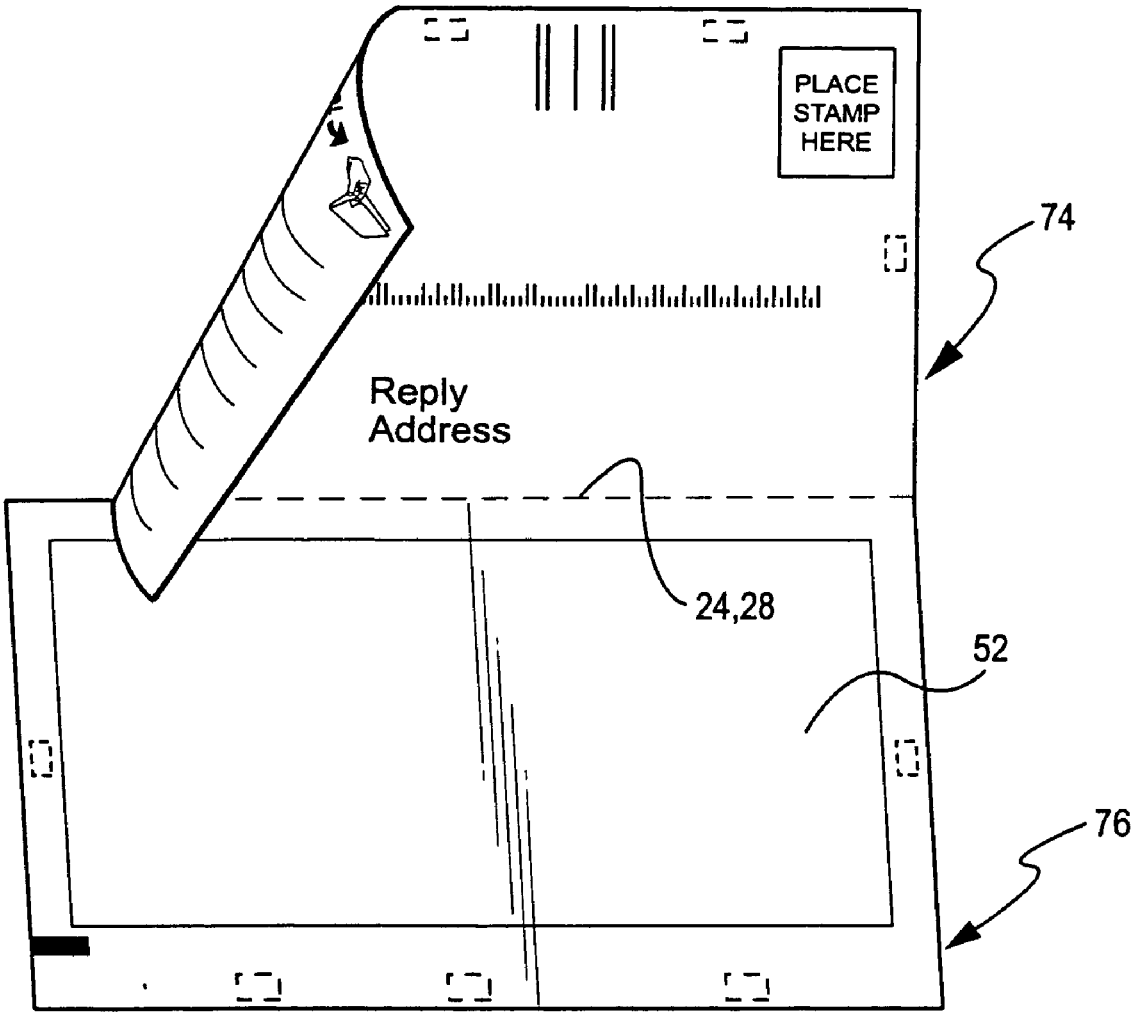
FIG. 6 is a perspective view of the open mailer showing the return postcard being removed by the recipient.

The recipient can open the mailer to separate the postcard ply 74 from the notice and reveal the information printed in section 52 by using a finger, pencil or letter opener to disrupt adhesive spots 68, 70. As an alternative to all or some of adhesive spots 68, 70, the mailer may be held closed by edge tabs as schematically shown at 78. Once the return postcard 74 has been separated from the Notice 76, it can be removed by tearing along aligned lines of weakness 24,28, as shown in FIG. 6.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A double postcard size mailer including an integral laminated postcard size reply mail piece which is detachable from said mailer, said mailer comprising:

a quadrate sheet of paper having parallel top and bottom edges, parallel first and second side edges perpendicular to the top edge and first and second faces;

at least first, second and third fold lines parallel to said top and bottom edges dividing said sheet into at least first, second, third, and fourth panels, said first and fourth panels being substantially the same size and said second and third panels being substantially the same size;

first adhesive areas provided on the second face of at least one of said first and fourth panels, and on the second face of at least one of and second and third panels for substantially permanently adhering mutually facing portions of said first and fourth panels and mutually facing portions of said second and third panels together as respective first and second postcard plies when said sheet is double V-folded about said fold lines; and a second adhesive for securing said first and second postcard plies together as an outgoing mailer;

said sheet being folded such that (1) said second surfaces of said first and fourth panels lie in contact and are adhered together by said first adhesive pattern to form said postcard size reply mail piece, and (2) said second surfaces of said second and third panels lie in contact and are adhered together by said first adhesive pattern to defining a postcard size outgoing mail piece, and (3) said first surfaces of said first and second panels lie in contact and are held together by said second adhesive.

2. A double postcard size mailer as in claim 1, wherein said second adhesive comprises a second adhesive pattern, defined on the first face of at least one of said first and second panels for holding said panels in opposed facing relation.

3. A double postcard size mailer as in claim 1, wherein said second adhesive comprises at least one adhesive tab for holding mutually aligned edges of said first and second postcard plies together as an outgoing mailer.

4. A double postcard size mailer as in claim 1, wherein the first adhesive areas are provided about a periphery of said mutually facing portions.

5. A double postcard size mailer as in claim 1, wherein the first adhesive areas provided on the second face of at least one of said first and fourth panels are provided adjacent side, top and bottom edges thereof, and the first adhesive areas provided on the second face of at least one of and second and third panels are provided adjacent side edges thereof.

6. A double postcard size mailer as in claim 1, wherein said first adhesive pattern comprises pressure activatable adhesive.

* * * * *